US007794178B2

(12) United States Patent
Golden et al.

(10) Patent No.: US 7,794,178 B2
(45) Date of Patent: Sep. 14, 2010

(54) PATIO PIER

(75) Inventors: James T. Golden, Cullman, AL (US); Dondi Garrison, Falkville, AL (US)

(73) Assignee: Patio Piers, Inc., Cullman, AL (US)

( * ) Notice: Subject to any disclaimer, the term of this patent is extended or adjusted under 35 U.S.C. 154(b) by 328 days.

(21) Appl. No.: 12/051,446

(22) Filed: Mar. 19, 2008

(65) Prior Publication Data

US 2008/0253844 A1 Oct. 16, 2008

Related U.S. Application Data

(60) Provisional application No. 60/911,028, filed on Apr. 10, 2007.

(51) Int. Cl.
*B63C 1/00* (2006.01)

(52) U.S. Cl. ..... 405/218; 114/263

(58) Field of Classification Search ..... 405/218–220; 114/263, 264; 40/606.09, 611.01, 620, 644
See application file for complete search history.

(56) References Cited

U.S. PATENT DOCUMENTS

| | | | | |
|---|---|---|---|---|
| 4,123,912 | A * | 11/1978 | Meldrum | 405/220 |
| 4,126,006 | A | 11/1978 | Lewis | 405/220 |
| 4,645,380 | A * | 2/1987 | Hambrick et al. | 405/220 |
| 4,683,833 | A | 8/1987 | Meriwether | 114/263 |
| 5,199,370 | A | 4/1993 | Berquist | 114/263 |
| 5,788,416 | A | 8/1998 | Wolgamut | 405/218 |
| 6,179,525 | B1 | 1/2001 | Gruhn | 405/219 |
| 6,217,259 | B1 | 4/2001 | Godberson | 405/218 |
| 6,318,932 | B1 | 11/2001 | Tyler | 405/218 |
| 6,746,181 | B1 * | 6/2004 | Heintz et al. | 405/219 |
| 7,241,078 | B2 | 7/2007 | Surges | 405/220 |

OTHER PUBLICATIONS

Exhibit A: Thetablegator.com website printout (4 pages) (undated but admitted to be prior art).
Exhibit B: The American Tailgater Company printout from cartserver.com (2 pages) (undated but admitted to be prior art).
Exhibit C: Mytailgate.com website printout (4 pages) (undated but admitted to be prior art).
Exhibit D: Truckspike.com website printout (4 pages) (undated but admitted to be prior art).
Exhibit E: Tailgatingsupplies.com website printout (2 pages) (undated but admitted to be prior art).

* cited by examiner

*Primary Examiner*—David J Bagnell
*Assistant Examiner*—Benjamin Fiorello
(74) *Attorney, Agent, or Firm*—Waddey & Patterson, P.C.; Lucian Wayne Beavers; Andrew J. Thomson

(57) ABSTRACT

An extension for a dock including a platform having a one or more sleeves in which accessory members can be inserted and secured/locked. The platform is pivotally attached to a foundation member, which may be engaged to a pier or a dock, so that the platform from rotate from a operating position, parallel to the dock or pier's surface, to a stored position, perpendicular to the dock or pier's surface.

20 Claims, 5 Drawing Sheets

PATIO PIER

CROSS-REFERENCES TO RELATED APPLICATIONS

This application is a non-provisional application which claims benefit of co-pending U.S. patent application Ser. No. 60/911,028 filed Apr. 10, 2007, entitled "Patio Pier—an enhancement for pier and dock structures (metal and wood)" which is hereby incorporated by reference.

BACKGROUND OF THE INVENTION

The present invention relates generally to dock and pier extensions. More particularly, this invention pertains to modular, customizable dock and pier extensions that can quickly and easily be stored when not in use. Water-based recreation and entertainment activities are common throughout the United States. The epicenter of much of this activity is a dock or pier (together with foundation structure, hereinafter collectively referred to as "dock"). The dock provides a station to embark/disembark from a boat or other water-based vehicle, to gather and socialize with acquaintances, to fish, to prepare meals, to simply relax and enjoy the surroundings, or any other myriad activities.

Unfortunately, enjoyment of a dock can often be limited due to the size or configuration of the dock. In some cases this deficiency can be remedied while in others it cannot. For instance, it may be possible to increase the dock's size through new construction, e.g. an addition to the dock. However, it is not the aberrant scenario when such an addition is cost prohibitive. In others cases, a permanent dock addition may not even be feasible due to the proximity of other docks or strictures on permanent dock additions—such strictures are often mandated by local, state, or federal agencies.

The prior art has not ignored this dilemma. Rather, the prior art is replete with attempts to create dock structures or supplement existing docks. For example, U.S. Pat. No. 6,217,259, issued to Godberson, discloses a portable, modular dock system that includes multiple interconnected dock segments and a collection of adjustable legs, to support the dock segments, which can be matched to the lake depth.

U.S. Pat. No. 6,318,932, issued to Tyler, describes a retractable dock having a first end hingedly connected a shore-based mounting structure. The shore-based mounting structure includes a vertical tower. A cable is strung from the shore to the second end of the dock, the end opposite the first end, through the tower so that the dock may be hoisted out of the water by retracting the cable—this allows the dock to pivot up out of the water, about the mounting structure, and store in a vertical position proximate the tower.

Another prior art dock, U.S. Pat. No. 5,788,416 issued to Wolgamut, teaches a modular dock having a plurality of dock sections, transverse members, longitudinal members, and support legs that can be assembled to create a dock having a desired configuration. Further, '416 claims that the modular dock can be assembled by a single person.

U.S. Pat. No. 4,126,006, issued to Lewis, discloses a boat dock assembled from portable sections hingedly connected to each other and provided with foldable and adjustable leg assemblies to accommodate various geographic topologies. The dock can be enlarged by the addition of more portable sections.

The prior art also includes a plethora of modular floating dock designs, such as those described in U.S. Pat. No. 5,199,370 issued to Berquist and U.S. Pat. No. 6,179,525 issued to Gruhn et al. Unfortunately, reconfiguring floating dock assemblies often requires the significant effort of towing the modular dock sections between the shore and the dock assembly every time a disparate dock arrangement is desired. Moreover, storing the floating dock sections is no less a vexatious endeavor.

Another frustration encountered by dock owners is the hardship involved in securing dock accessories to the dock. This hardship may involve, for example, attempting to secure an umbrella to the dock to provide relief from the sun, securing a grill to the dock to prepare food, or simply mounting a chair to the dock so that the chair will not be thrown into the water by wind or accidental contact. Typically, a dock owner either tries to kluge together a rigging structure to secure the accessory to the dock or the dock owner must employ a bulky, heavy accessory that comes with an integral securement system.

Regardless of the technique utilized, the dock owner must store the dock accessories when not in use—a concern of great import to those dock owners having a house or storage facility far from the dock. This can involve hauling the accessories back and forth between the dock and the storage location or packing up the accessories and storing them in a dock-side locker. Either option has multiple drawbacks, such as the effort needed to transport the dock accessories to and from a remote storage location and/or the necessity to have a sufficiently large dock-side locker (which can be costly and offensive to the landscape).

What is needed, then, is a cost-effective, modular dock that can provide additional dock space when needed, have the ability to store inside the footprint of the original dock structure, and provide the capability to secure/store dock accessories to the dock.

BRIEF SUMMARY OF THE INVENTION

The present invention relates generally to dock and pier extensions and particularly to modular, customizable dock and pier extensions that can quickly and easily be stored when not in use and provide the ability to secure and store dock accessories.

The present invention includes a pier extension. The pier extension is the platform used to extend the existing dock/pier. Additionally, multiple pier extensions may be coupled together to create an even larger dock extension assembly. The edge of the pier extension proximate the dock includes a rigid curvilinear projection. Also provided is a receiver attached to the dock, shaped complementary to the pier extension's projection, so that the receiver and the projection can mate to pivotally secure the pier extension to the dock.

The engagement between the projection and the receiver is such that the pier extension can rotate about the engagement point to "fold up." In other words, the projection and the receiver form a hinge between the dock and the pier extension. Thus, in operation, the pier extension is in an extended position coplanar with the dock to increase the overall size of the dock. When the pier extension is not in use, it may be pivoted about its engagement to the dock so that the pier extension is transitioned into a stored position, orthogonal/perpendicular relative to the dock. This allows the dock to retain its original footprint when the pier extension is in the stored position.

The present invention also provides a structure and arrangement that accommodates the securement and/or storage of dock accessories. The pier extension includes one or more sleeves extending through the upper surface of the pier extension down into the body of the extension. The present invention also has a locking mechanism with a slide that extends into the body of the extension and is slidably engaged to the sleeves. An accessory may be inserted into the sleeve so that when the slide engages the sleeve it also engages a notch or slot in the accessory thereby preventing the accessory from being removed. When the slide is disengaged from the sleeve and the accessory, the accessory may then be removed. This arrangement allows accessories to be readily positioned in/on the dock and stored, without concern of unwanted removal, if desired. Further, such an arrangement allows for any number of accessories to be attached to the pier extension as long as the accessory includes a base that may be received into the sleeve.

DETAILED DESCRIPTION OF THE INVENTION

Figure 1:
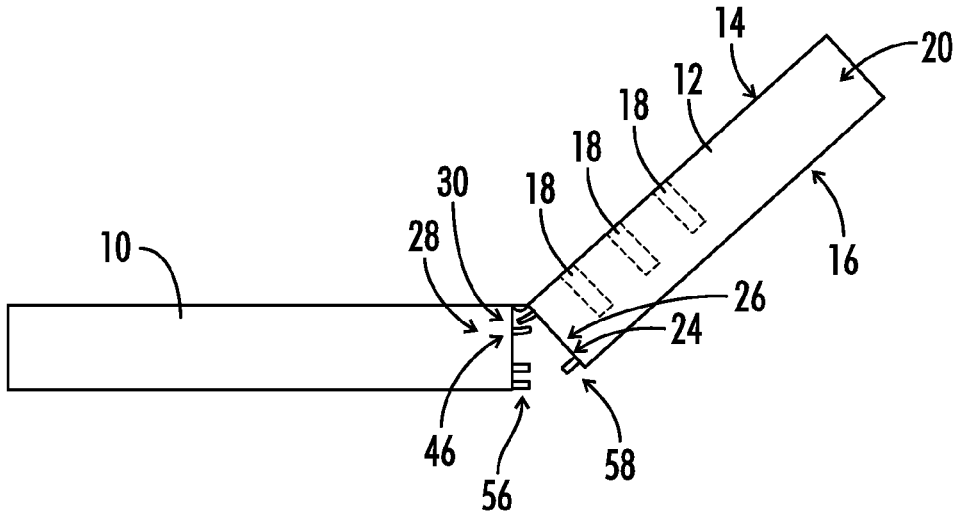
FIG. 1 is a side view of a dock and a partially rotated pier extension.

The present invention relates generally to dock and pier extensions. More particularly, the invention pertains to modular, customizable dock and pier extensions that can quickly and easily be stored. Now referring the figures. FIG. 1 illustrates a pier extension 12 or platform 12 coupled to a dock 10 or pier 10. The dock 10 may be a permanent or temporary structure. Further, the present invention envisions that the platform 12 may couple to a structure that extends into and/or over water, an isolated dock (a dock without any land-based connections), a retaining wall, boat slips, walk ways to boat slips, or any other structure that is adjacent aquatic environments. Additionally, the present invention can be attached to decks on houses or building or other structures, outside of the aquatic environment, accepting of the invention.

In the preferred embodiment the platform 12 is made from extruded aluminum. However, the platform 12 may also be fabricated from any metallic material, plastic, cellulose-based material, or ceramic. Further, depending on the application, the platform 12 may be grated/porous or have continuous surfaces. The platform 12 has a top 14 (or upper surface 14 or entertaining surface 14), a bottom 16 (or lower surface 16), and a chamber 20 (or cavity 20) defined therebetween. In the operating position, i.e. the extended position parallel to the dock 10, the bottom 16 is proximate the water. The chamber 20 may be described as a void or cavity in the body of the platform 12. The chamber 20 may be one large cavity or a collection of smaller cavities.

Figure 4:
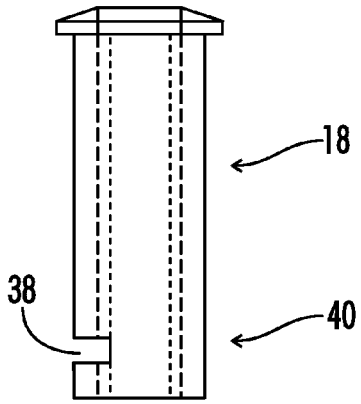
FIG. 4 is a side view of an aperture detailing the notch.

The platform 12 may also include one or more apertures 18, also referred to as sleeves 18 or vessels 18. The apertures form openings through the top 14 and allow access into the body of the platform 12 and specifically access into the chamber 20. The apertures 18 may extend all the way through the platform 12 to create a bore from the top 14, through the chamber 20, and out the bottom 16. However, in the preferred embodiment, the apertures 18 do not extend out through the bottom 16. The apertures 18 may contain inserts positioned therein to define a border between the expanse of the chamber 20 and the aperture 18. It is also envisioned by the present invention that the apertures 18 are analogous to sleeves that inherently act as the inserts would, i.e. the sleeves define the boundary between the chamber 20 and the volume occupied by the aperture 18. The aperture 18, or insert, may also have a bottom end 40, proximate the bottom of the platform 16, with a notch 38 defined therein, as shown in FIG. 4. The notch 38 may extend around a majority of the circumference of the aperture 18 or may simply be a recess in one portion of the aperture 18.

Figure 2:
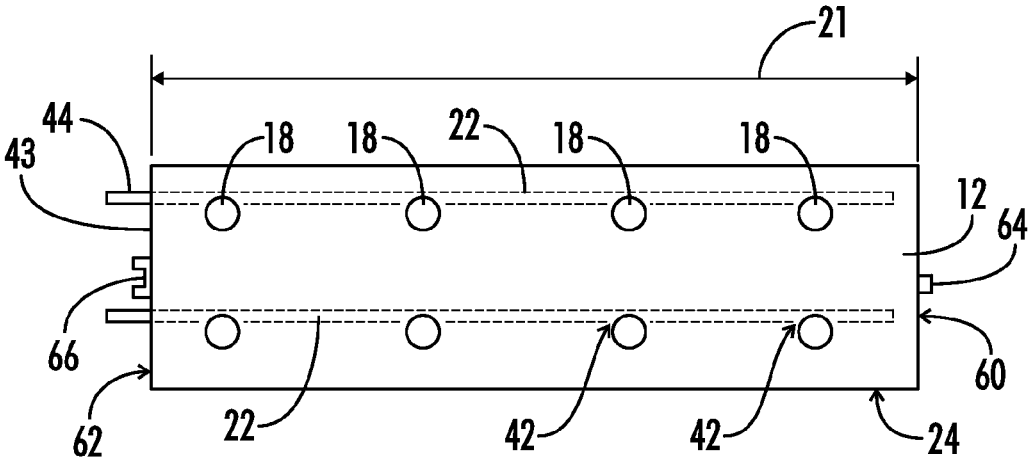
FIG. 2 is a top cross-sectional view of the platform with apertures arranged at regular intervals and the channels engaged to the apertures and/or accessory members so that the accessory members can be inserted or removed.

Desirably, the platform 12 will contain multiple apertures 18 placed at regular intervals along the platform 12, as shown in FIG. 2. Even more desirably, the apertures 18 are arranged along a grid defined by a Cartesian coordinate system, i.e. the apertures 18 are lined up in vertical and/or horizontal rows and columns to create a rectangular grid. Benefits of such organized positioning will be expounded upon below.

The present invention also includes a securement member 22 or a locking apparatus 22. The securement member 22 is at least partially positioned in the chamber 20 and engaged to the platform 12 so that the securement member 22 may move between any number of predetermined positions within the chamber 20. The securement member 22 is also located so that it may engage/disengaged one or more of the apertures 18 as the member 22 moves through its range of motion. In one preferred embodiment, the securement member 22 includes a slide. The slide may be a linear arm extending to, and interacting with, multiple apertures 18. To this end, a preferred embodiment describes a securement member 22 having a length, measured parallel to the width 21 of the platform 12, greater than the majority of the width of the platform 12. The present invention also envisions a securement member 22 positioned on an exterior surface of the platform 12.

Figure 5:
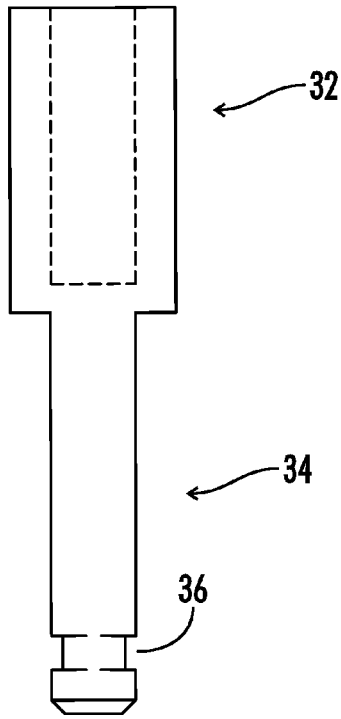
FIG. 5 is a side view of an accessory member showing the groove.

The present invention may also include an accessory member 32. The accessory member 32 may be attached to the platform 12. More specifically, the accessory member 32 may have a bottom portion 34 containing a groove 36 as shown in FIG. 5. Preferably, the groove 36 spans across the entire circumference of the accessory member 32 but it is not required to do so. Desirably, the groove 36 should be located at least some distance up from the end of the accessory member 32. The accessory member 32 may be attached to the platform 12 by inserting the bottom portion 34 of the accessory member 32 into the aperture 18. Once received by the aperture 18, the groove 36 should align with the notch 38 in the aperture 18. Thus, after the accessory member 32 has been positioned in the aperture 18, the groove 36 and notch 38 are vertically coextensive.

Figure 3:
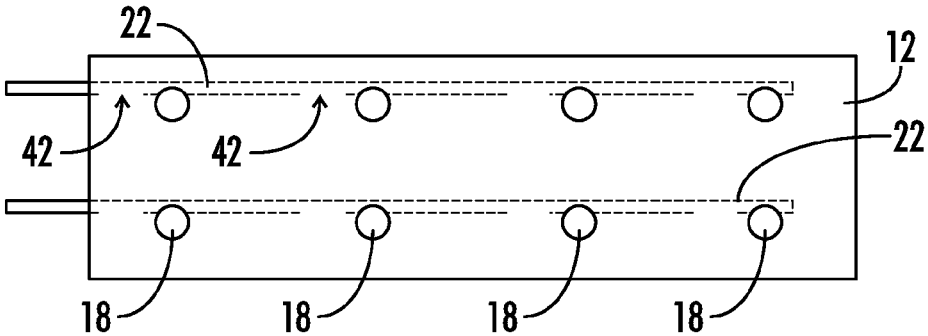
FIG. 3 is a top cross-sectional view of the platform with apertures arranged at regular intervals and the channels disengaged from the apertures and/or accessory members so that the accessory members cannot be inserted or removed.

The securement member 22, or the slide in some embodiments, may include a channel 42 or a series of channels 42, as shown in FIGS. 2 and 3, along the length of the member 22. A channel 42 may simply be described a cutout from the width of the member 22. The member 22 is movably engaged to the platform 12 such that as the member 22 travels along its range of motion, the channels 42 engage and disengage the groove 36 and/or notch 38. The engagement of the channel 42 to the aperture 18 is depicted in FIG. 2. For instance, as long as the channel 42 is engaged to the groove 36, an accessory member 32 can be inserted into and removed from the aperture 18 (and hence the platform 12) because the channel 42 does not intrude into the aperture 18. Conversely, if the channel 42 is not engaged to the groove 36 and/or notch 38 then the accessory member 32 will be prevented from entering or leaving the aperture 18. Alternatively described, if the accessory member 32 has been fully inserted into the aperture 18 and the channel 42 is not engaged to the notch 38, meaning a portion of the securement member 22 is being received into the notch 38, the interaction between the notch 38, the groove 36, and the securement member 22 will preclude the accessory member 32 from be pulled out, as shown in FIG. 3. This arrangement functions to secure the accessory member 32 to the platform 12.

To actuate the securement member 22, thereby locking or unlocking the accessory member 32, a slide manipulator 44 may be used. Advantageously, the manipulator 44 can be located on the exterior surface 43 of the platform 12 so that the actuation can be accomplished without breaching the platform 12. The manipulator 44 may include a lock that can be used to prevent the manipulator 44 from actuating. Thus, if a dock owner wished to leave one or more accessory members 32 on the platform 12, the lock could be used to prevent others from removing them. This utility is enhanced when one considers that accessory members 32 can embody chairs, fishing seats, ladders, rod holders, grills, umbrella, fish cleaning table, benches, storage units/lockers, ski holders, lantern holders, flag pole, tackle box stand, rails/railings, etc.

Referring to FIG. 1, the platform 12 may also have a platform edge 24 (also referred to as a periphery section 24 or edge section 24) with a foundation coupling section 26 (also referred to as platform hinge coupler 26 or pier extension coupler 26). The platform edge 24 can be described as extending between the top 14 and bottom 16 of the platform 12, specifically between the perimeter portions of the top 14 and bottom 16 proximate the dock 10 when the platform 12 is in the operating position.

The invention also includes a foundation member 28 (alternatively referred to as a pier receiver 28 or foundation hinge coupler 28) attached to the dock 10 at the foundation mount 46. The foundation member 28 functions to connect to the foundation coupling section 26 to provide a movable engagement between the dock 10 and the platform 12. This movable engagement can be described as a pivotal or hinged-type engagement. The engagement allows the platform 12 to transition between an operating position, substantially parallel to the dock's surface, and a stored position, roughly perpendicular to the dock's surface. The ability to change to a stored position imbues the dock 10 with the ability to maintain its size footprint—important in many settings.

The foundation member 28 has an attachment section 30, also referred to as a distal section 30, complementary to the foundation coupling section 26. The complementary relationship simply defines the capacity of the attachment 30 and the foundation coupling section 26 to provide a pivotal or rotatable engagement. One preferred method to implement the rotatable or pivotal engagement is described below; however any hinge-type connection is in the scope of the present invention.

Figure 6:
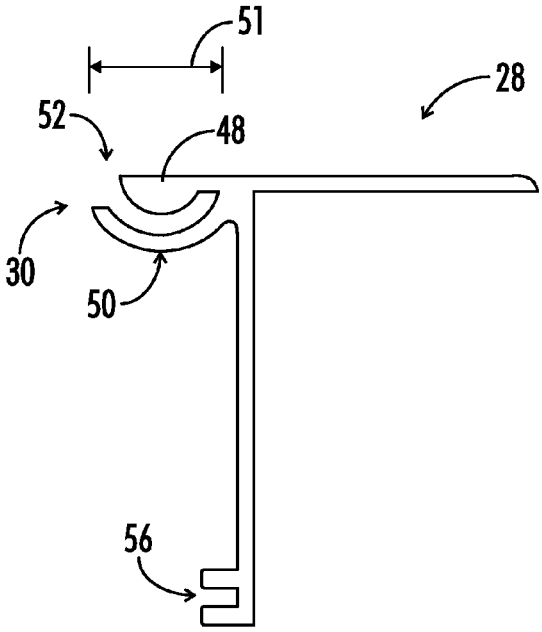
FIG. 6 is a side view of the foundation member.
Figure 7:
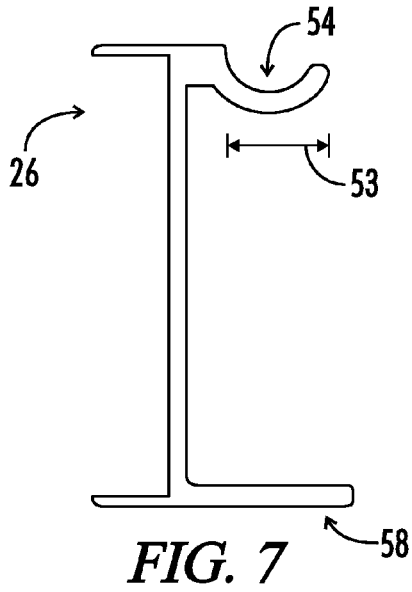
FIG. 7 is a side view of the foundation coupling section.

The attachment section 30 may have a curved upper flange 48 (also referred to as first protrusion 48) and a curved lower flange 50 (also referred to as second protrusion 50) defining an edge coupling receiver 52 (also referred to as a coupler receptacle 52 or jacket 52) as shown in FIG. 6. In one embodiment, the edge coupling receiver 52 is proximate the top of the platform 14 when the platform 14 is in its operating position. The foundation coupling section 26 may have an insert 54 (or rigid curvilinear projection 54 or neck 54), with a width less than that of the opening width of the edge coupling receiver 52, extending away from the platform 12 and preferably, incurvated to match the edge coupling receiver 52, as shown in FIG. 7. This allows the insert 54 to be received into the edge coupling receiver 52 when the platform 12 is engaged to the dock 10. Further, the edge coupling receiver 52 can be described as being dimensioned to accept the insert 54 and in most embodiments the insert 54 has a length 53 less than the length 51 of the edge coupling receiver 52 so that the platform's full range of motion is not hindered by the insert 54 "bottoming out" in the edge coupling receiver 52. This configuration allows the dock 10 and the platform 12 to pivot relative to each other.

To further enhance the efficacy of the present invention, the foundation member 28 may include a socket 56 distal from the edge coupling receiver 52 and the platform 12 may include an arm 58 distal from the curved insert 54, with the arm 58 located on or proximate the platform edge 24. When the platform 12 is in the operating position, the socket 56 will receive the arm 58 to provide an additional engagement point between the dock 10 and platform 12. In the operating position, the socket 56 is at a lower elevation than the edge coupling receiver 52 and the arm 58 is at a lower elevation than the foundation coupling section 26.

To provide a sturdy and dependable engagement between the platform 12 and the dock 10, the preferred embodiment advances that the attachment section 30 and the foundation coupling section 26 have widths not less than half the width of the platform 12. This provides a large surface over which to distribute the forces encountered by the platform 12 and the dock 10. However, the invention also envisages applications where the widths of the attachment section 30 and the foundation coupling section 26 are significantly less than half of the width of the platform 12.

One configuration of the present invention may have multiple platforms 12 connected together. To accomplish this, the platform(s) 12 should have a first side periphery 60 perpendicular to the front edge of the platform or platform edge 24 (the edge closest to the dock 10) and a second side periphery 62 opposite the first 60 and a platform width defined there between, as shown in FIG. 2. The first side periphery 60 includes a first connector 64 and the second side periphery 62 includes a second connector 66. The first and second connectors 64 and 66 are shaped to correlate to each other, i.e. they fit together, and can run the entire length of the side peripheries or only a portion thereof. The orientation between the first and second connectors 64 and 66 should be consistent on all platforms 12, so that any two platforms 12 can join together. Now as one platform 12 is placed next to another platform 12 the first connector 64 from one platform can be engaged to the second connector 66 from the other platform to secure the two platforms together (in essence create a wider pier extension comprised of multiple platforms 12).

Figure 10:
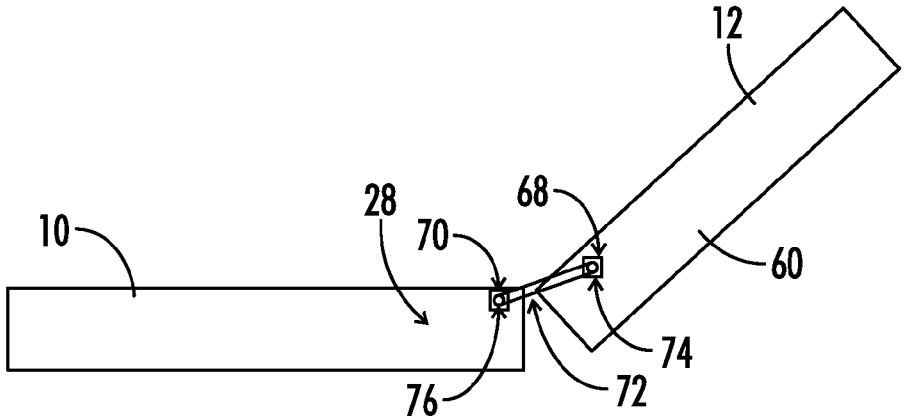
FIG. 10 is a side view of the present invention detailing the damping assembly.
Figure 11:
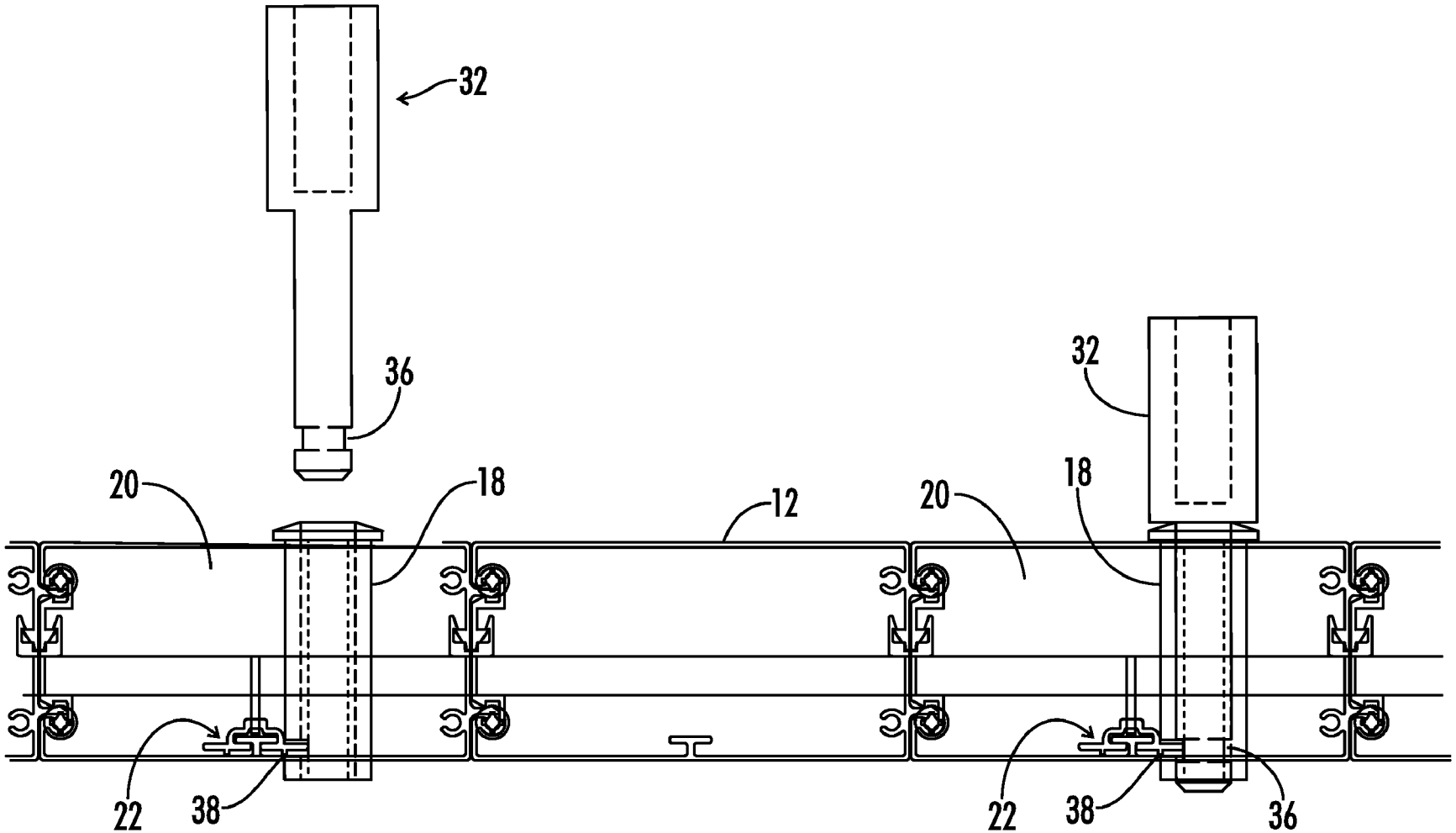
FIG. 11 is a cross-sectional side view of the present invention.

Although, in the preferred embodiment, the platform 12 is fabricated from aluminum, it may still be advantageous to have a system that supports some of the platform's weight, and controls the platform's movement, as the platform 12 is transitioned from an operating to a stored position and vice versa. To this end, the platform 12 provides a first damping assembly connector 68 (or first strut connector 68) and the foundation member 28 includes a second damping assembly connector 70 (or second strut connector 70) as shown in FIG. 10. Further, a damping assembly 72 with a platform mounting unit 74 is coupled to the first damping assembly connector 68 and a foundation member mounting unit 76, or foundation hinge coupler mounting unit 76, coupled to the second damping assembly connector 70. The damping assembly 72 (or strut 72) may be a strut, shock, or other device that facilitates the transition between a stored and operating position. It is also in the scope of the present invention to have a second damping assembly connector 70 exclusive of the foundation member 28. For instance, the second damping assembly connector 70 may be attached to the dock 10 or an adjacent structure. Further, the first damping assembly connector 68 may be attached to any portion of the platform but in the preferred embodiment, the first damping assembly connector 68 is located proximate the first side periphery 60 or the second side periphery 62.

Although the preceding discussion has focused on an attachment section 30 that receives the foundation coupling member 26 and a socket 56 that receives the arm 58, the invention also envisions configurations with these roles reversed. Namely, the receiving components (attachment section 30 and socket 56) could be located on the platform 12 and the components being received (the foundation coupling member 26 and the arm 58) could reside on the dock 10.

Figure 8:
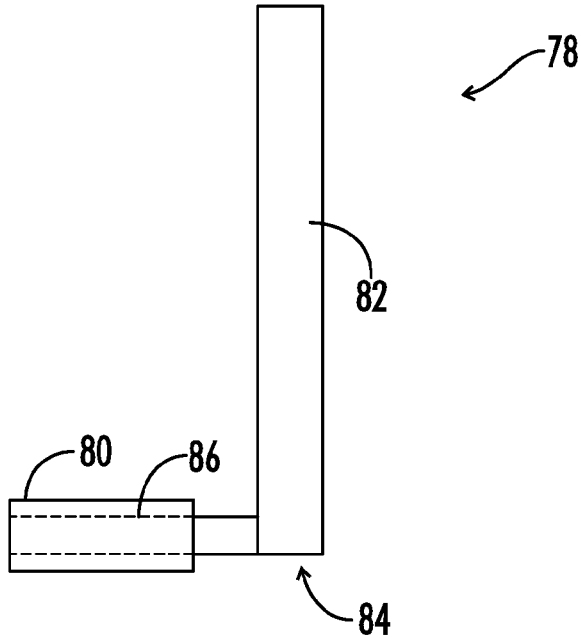
FIG. 8 is a side view of the tailgate station in the stored position.
Figure 9:
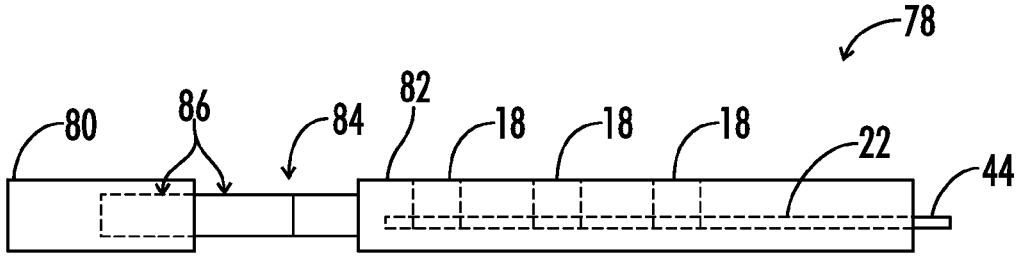
FIG. 9 is a side view of the tailgate station in the operating position.
Figure 12:
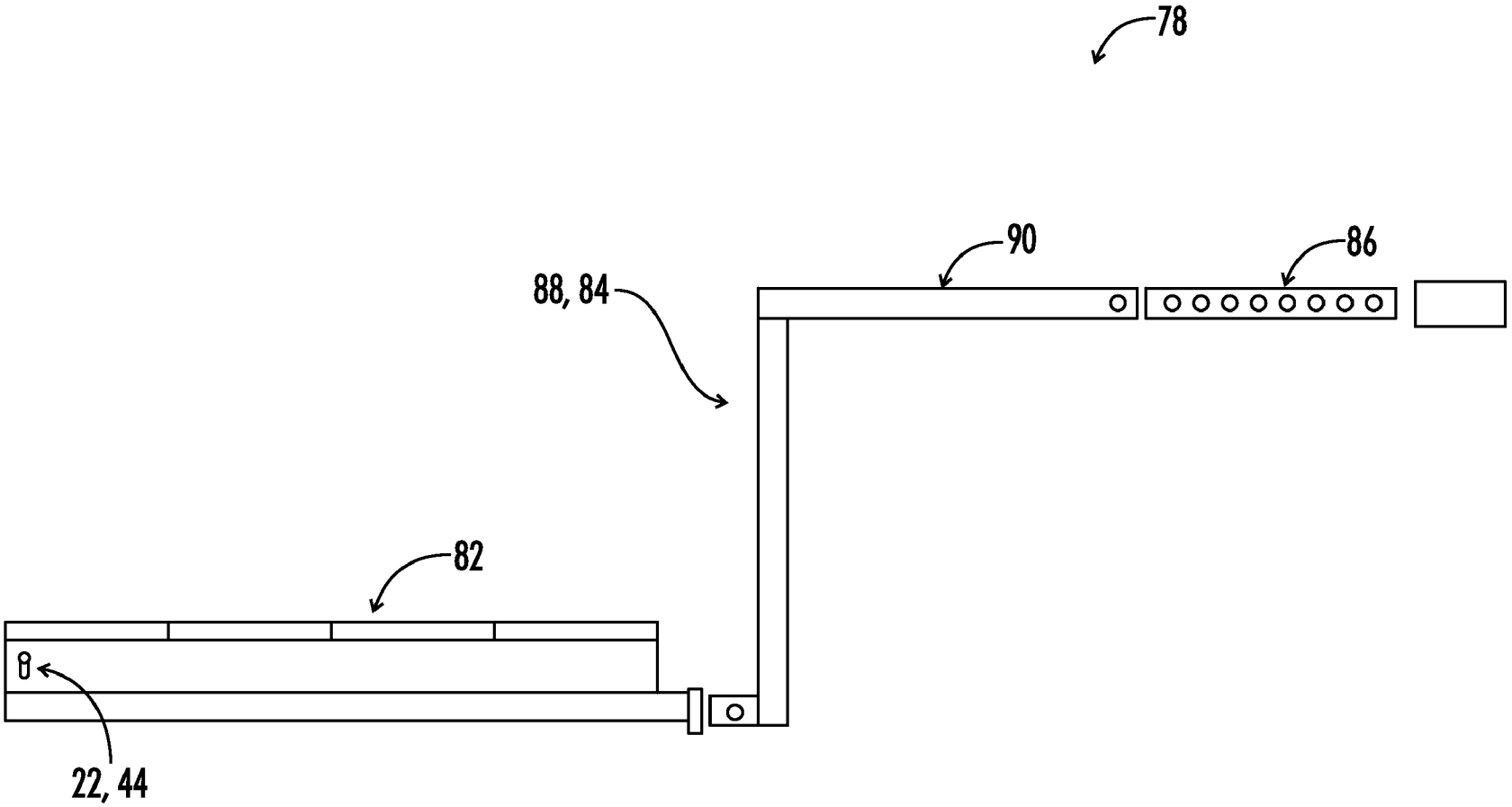
FIG. 12 is a side view of the tailgate station in an operational position.

Another embodiment of the present invention is illustrated in FIGS. 8, 9, and 12 and may be referred to a tailgate station 78. The tailgate station 78 can be attached to the tow hitch/receiver of a vehicle and provide a folding platform to accommodate many tailgating activities. Tailgating activities are commonplace at many sporting events and social gathering.

The tailgate station 78 includes a hitch connector 80 which can be attached to a tow hitch/receiver or bumper of a vehicle in any number of techniques well known in the prior art. The tailgate station 78 also includes a platform 82, having many of the same components and functions as platform 12 discussed above. Specifically, the platform 82 has one or more apertures 18 with the ability to receive accessory members 32, a securement member 22, a slide manipulator 44, and a multi-position hinge 84. The hinge 84 allows the platform 82 to move between a stored position, i.e. substantially vertical, to an operating position, i.e. substantially parallel to the ground. When the platform 82 is in the stored position the vehicle may operate without the concern of having the tailgate station 78 significantly extending the length of the vehicle. When the vehicle reaches its destination, the platform 82 can be transitioned into the operating position and accessory members 32 can be inserted into the apertures 18.

The hitch connector 80 may also include an extender 86. The extender 86 can be protracted from the hitch connector 80 to extend the platform 82 out away from the vehicle (the extender 86 can also be retracted back into the hitch connector 80 when desired). As the tow hitch/receiver on some vehicles is quite high, the multi-position hinge 84 may also function to drop, i.e. decrease the elevation, of the platform 82, relative the vehicle hitch, so that the platform 82 is closer to the ground and the accessory members 32 are more easily accessible. Alternatively worded, the hitch connector 80 and the platform 82 are parallel and the multi-position hinge 84 causes the vertical offset between the platform 82 and connector 80 (the combination forms a "Z" shape). The configuration and interaction of the securement member 22, the slide manipulator 44, the apertures 18, and the accessory members 32 operate as previously discussed to allow the person tailgating to leave the vehicle unattended without concern that the accessory members 32 will be unwontedly removed. The present invention also envisions that a locking apparatus can be integrated into the hitch connector 80 to prevent the entire tailgate station 78 from being detached from the vehicle.

Another embodiment of the tailgate station 78 is depicted in FIG. 12. In this embodiment, the extender 86 engages the hitch of the vehicle and the slide housing 90 permits the platform 82 to move away from the vehicle (the extender 86 may retract into the slide housing 90). A vertical offset member 88 functions to lower, or raise the platform 82 relative to the vehicle hitch. In some embodiments, the vertical offset member 88 may be a component of the hinge 84. The platform 82 may disengage from the offset member 88 if desired.

Thus, although there have been described particular embodiments of the present invention of a new and useful Patio Pier, it is not intended that such references be construed as limitations upon the scope of this invention except as set forth in the following claims.

What is claimed is:

1. An entertaining structure, comprising:

a platform having one or more cavities, an entertaining surface with a vessel extending through the entertaining surface down into at least one of the one or more cavities, wherein the vessel has a diameter and a bottom end with a notch defined therein;

a locking apparatus operably engaged to the platform and at least partially positioned in at least one of the one or more cavities proximate the vessel, wherein the locking apparatus includes a slide; and an accessory member having a bottom portion, with a diameter less than the diameter of the vessel, and a groove, wherein the bottom portion is removably received into the vessel and, when received, the groove is aligned with the notch and the slide is disengagedly received in the notch and the groove.

2. The entertaining structure of claim 1, wherein the slide comprises a channel, and further wherein the channel is disengagedly received in the notch and the groove.

3. The entertaining structure of claim 2, wherein the platform includes an exterior surface and the locking apparatus comprises a slide manipulator engaged to the exterior surface of the platform and operably connected to the slide to cause the channel to engage and disengage the notch and the groove.

4. The entertaining structure of claim 1, wherein the slide of the locking apparatus has a length, the platform has a width, and the length of the slide is greater than half the width of the platform.

5. The entertaining structure of claim 1, wherein:

the platform comprises a dock extension and includes a periphery section with a platform hinge coupler; and the entertaining structure further comprises a foundation hinge coupler having a foundation mount adapted to attach to a foundation structure and a distal section rotatably engaged to the platform hinge coupler.

6. The entertaining structure of claim 5, wherein:

the foundation mount is attached to a dock, and the foundation hinge coupler is operably engaged to the platform hinge coupler to allow the platform to articulate from an extended parallel position to an upright stored position relative to the dock.

7. The entertaining structure of claim 6, wherein:

one of the platform hinge coupler and the foundation hinge coupler includes a socket, and the other of the platform hinge coupler and the foundation hinge coupler includes an arm, wherein the arm is removably received in the socket when the platform is in the extended parallel position.

8. The entertaining structure of claim 6, wherein the platform has a width and each of the platform hinge coupler and the foundation hinge coupler has a width not less than half the width of the platform.

9. The entertaining structure of claim 6, wherein the slide has a length measured parallel to the width of the platform and the length of the slide is greater than the majority of the width of the platform.

10. The entertaining structure of claim 6, wherein the platform has a first side periphery and a second side periphery opposite the first side periphery, wherein the first side periphery comprises a first connector and the second side periphery comprises a second connector correlated to the first connector.

11. The entertaining structure of claim 6, wherein the platform includes a first damping assembly connector and the foundation hinge coupler includes a second damping assembly connector, further comprising:

a damping assembly with a platform mounting unit coupled to the first damping assembly connector and a foundation member mounting unit coupled to the second damping assembly connector.

12. The entertaining structure of claim 1, wherein:

the platform comprises a tailgate station and includes a hitch connector for connecting the platform to a vehicle.

13. An entertaining structure, comprising:

a platform having a top surface;

a plurality of mounting openings defined in the platform, and extending downwardly into the platform from the top surface; and a locking member, movable relative to the platform and operably associated with at least two of the mounting openings, the locking member including a plurality of channels arranged so that in an unlocked position the channels are in registry with the associated mounting openings so that accessories may be inserted in or removed from the mounting openings, and a locked position wherein the locking member prevents accessories from being inserted in or removed from the mounting openings.

14. The entertaining structure of claim 13, wherein:

each of the mounting openings is defined by a sleeve, including a notch defined through a sidewall of the sleeve, the notch communicated with the mounting opening; and the locking member is an elongated sliding locking member received in the notches of the sleeves.

15. The entertaining structure of claim 13, wherein:

the mounting openings comprise cylindrical bores; and the channels of the locking member are partially circular cutouts.

16. The entertaining structure of claim 13, wherein:

the plurality of mounting openings includes at least first and second rows of mounting openings;

the locking member is a first locking member associated with the first row of openings; and further comprising a second locking member associated with the second row of openings, the first and second locking members being elongated parallel locking members.

17. The entertaining structure of claim 13, further comprising:

an accessory post received in one of the openings, the accessory post having a groove defined therein; and wherein the locking member is received in the groove when the locking member is in its locked position.

18. The entertaining structure of claim 13, wherein:

the locking member is an elongated slide having a length;

the platform has a width parallel to the length of the slide; and the length of the slide is greater than one-half the width of the platform.

19. The entertaining structure of claim 13, further comprising:

a dock hinge portion for mounting upon a dock; and a platform hinge portion attached to the platform and engageable with the dock hinge portion to pivotally mount the platform on a dock.

20. The entertaining structure of claim 13, further comprising:

a hitch coupler for connecting the platform to a vehicle.

* * * * *

UNITED STATES PATENT AND TRADEMARK OFFICE

CERTIFICATE OF CORRECTION

PATENT NO. : 7,794,178 B2
APPLICATION NO. : 12/051446
DATED : September 14, 2010
INVENTOR(S) : James T. Golden and Dondi Garrison It is certified that error appears in the above-identified patent and that said Letters Patent is hereby corrected as shown below:

In the Abstract, line 1, delete "a" before --one--;
line 5, delete "from" before --rotate--;
line 5, replace "rotate" with --rotates--;
line 5, replace "a" with --an-- before --operating--.
Column 1, line 43, insert --to-- before --a shore-based--.
Column 3, line 48, insert --to-- before --the figure--.
Column 4, line 38, replace "disengaged" with --disengage--.
Column 4, line 66, insert --as-- before --a cutout--.
Column 5, line 17, replace "be" with --being--.
Column 7, line 27, insert --as-- before --a tailgate--.

Signed and Sealed this

Seventh Day of December, 2010

David J. Kappos

David J. Kappos
*Director of the United States Patent and Trademark Office*